US005392832A

United States Patent [19]

Colson et al.

[11] Patent Number: 5,392,832

[45] Date of Patent: Feb. 28, 1995

[54] COVERING ASSEMBLY FOR ARCHITECTURAL OPENINGS

[75] Inventors: Wendell B. Colson, Boulder; James M. Anthony, Denver; Brad H. Oberg; Brian M. Hoffmann, both of Westminster; Eric N. Williams, Louisville; Paul G. Swiszcz, Boulder, all of Colo.; Cornelis M. Jansen, Woudrichem, Netherlands

[73] Assignee: Hunter Douglas Inc., Upper Saddle River, N.J.

[21] Appl. No.: 977,788

[22] Filed: Nov. 30, 1992

Related U.S. Application Data

[63] Continuation-in-part of Ser. No. 810,331, Dec. 19, 1991, Pat. No. 5,287,908, and a continuation-in-part of Ser. No. 963,359, Oct. 20, 1992, Pat. No. 5,339,883, and a continuation-in-part of Ser. No. 963,318, Oct. 20, 1992.

[51] Int. Cl.[6] ..... E06B 3/94

[52] U.S. Cl. ..... 160/84.07; 160/168.1; 160/176.1

[58] Field of Search ..... 160/84.1 C, 84.1 D, 160/84.1 E, 166.1, 176.1, 177, 168.1, 172, 345, 900

[56] References Cited

U.S. PATENT DOCUMENTS

| | | | |
|---|---|---|---|
| 3,421,2 | 1/1969 | LaBarge . | |
| 286,027 | 10/1883 | Lobdell . | |
| 718,992 | 1/1903 | Emery . | |
| 1,958,695 | 5/1934 | Claus . | |
| 2,029,675 | 2/1936 | Schlamp . | |
| 2,140,049 | 12/1938 | Grauel . | |
| 2,620,850 | 12/1952 | Janowski . | |
| 2,688,356 | 9/1954 | Conti . | |
| 2,822,840 | 2/1958 | Reynolds . | |
| 2,834,412 | 5/1958 | Velke . | |
| 2,865,446 | 12/1958 | Cole . | |
| 3,125,154 | 3/1964 | Woodle . | |
| 3,299,943 | 1/1967 | Poe | 160/176.1 |
| 3,371,702 | 3/1968 | Keegan et al. . | |

(List continued on next page.)

FOREIGN PATENT DOCUMENTS

| | | |
|---|---|---|
| 0220074 | 4/1987 | European Pat. Off. . |
| 319458 | 11/1902 | France . |
| 847779 | 10/1939 | France . |
| 1309194 | 10/1962 | France . |
| 1321456 | 2/1963 | France . |
| 136467 | 5/1964 | France . |
| 1373515 | 8/1964 | France . |
| 2362264 | 3/1978 | France . |
| 122088 | 4/1900 | Germany . |
| 382758 | 5/1922 | Germany . |
| 1241361 | 5/1967 | Germany . |
| 7008554 | 10/1971 | Germany . |
| 3041983 | 9/1982 | Germany . |
| 3525515 | 1/1987 | Germany . |
| 8906284 | 9/1989 | Germany . |
| 6508988 | 1/1967 | Netherlands . |
| 7805464 | 10/1979 | Netherlands . |
| 951484 | 3/1964 | United Kingdom . |
| 1036126 | 7/1966 | United Kingdom . |
| 1116934 | 6/1968 | United Kingdom . |
| 1500438 | 2/1978 | United Kingdom . |
| 9106237 | 5/1991 | WIPO . |

*Primary Examiner*—David M. Purol
*Attorney, Agent, or Firm*—Gary M. Polumbus

[57] ABSTRACT

A covering for an architectural opening such as a window or door is in the form of a vertically oriented fabric assembly having front and rear sheer fabrics interconnected by vertically extending vanes. The vanes can be tilted through a series of carriers mounted on a track rail from which the covering is suspended in order to adjust the spacing between the fabrics between open and closed positions and adjust the light transmitting characteristics of the covering. The covering can be extended across the opening by separating the carriers on the track rail and can be contracted by stacking the carriers toward one end of the track rail. A unique design of carrier allows the covering to fold on itself in the contracted state, in the manner of a conventional drape.

39 Claims, 10 Drawing Sheets

U.S. PATENT DOCUMENTS 3,384,519 5/1968 Froget .
3,509,934 5/1970 Smart .
3,661,665 5/1972 Froget .
3,701,376 10/1972 Froget .
3,708,009 1/1973 Viol .
3,783,931 1/1974 Assael .
3,844,330 10/1974 Hyman ..... 160/84.16 X
3,851,699 12/1974 Shapiro ..... 160/168.1
3,860,056 1/1975 Bruneau .
3,946,789 3/1976 Ronkholz-Tolle ..... 160/84.1 C X
4,182,088 1/1980 Ball .
4,202,395 5/1980 Heck et al. .
4,332,288 6/1982 Frentzel et al. .
4,335,775 6/1982 Frentzel et al. .
4,344,474 8/1982 Berman .
4,434,834 3/1984 Ennes .
4,473,101 9/1984 Langeler .
4,519,434 5/1985 Forquer .
4,647,488 3/1987 Schnebly .
4,673,018 6/1987 Judkins .
4,687,038 8/1987 Clemente .
4,694,543 9/1987 Conley .
4,732,630 3/1988 Schnebly .
4,799,299 1/1989 Campbell .
4,858,668 8/1989 Toti ..... 160/84.1 C
4,862,941 9/1989 Colson ..... 160/84.1 D
4,885,190 12/1989 Schnebly .
4,912,900 4/1990 Yeamans .
4,915,153 4/1990 Toti ..... 160/345 X
5,002,628 3/1991 Schnebly .
5,012,552 5/1991 Wulf .
5,070,924 12/1991 Bateman .

COVERING ASSEMBLY FOR ARCHITECTURAL OPENINGS

CROSS REFERENCE TO RELATED APPLICATIONS

This application is a continuation-in-part of applications, Ser. No. 07/810,331, now U.S. Pat. No. 5,287,908, filed Dec. 19, 1991, for a Window Covering Assembly; Ser. No. 07/963,359, now U.S. Pat. No. 5,339,883, filed Oct. 20, 1992, for a Covering Assembly for Architectural Openings; and Ser. No. 07/963,318, filed Oct. 20, 1992, for a Window Blind Material and Window Covering Assembly.

FIELD OF THE INVENTION

The present invention relates to a covering assembly particularly for windows, doors and other architectural openings.

BACKGROUND TO THE INVENTION

There are many known forms of covering assemblies for windows, doors and the like including curtains, roller blinds, venetian blinds, drapery and the like. Recently there has been proposed a window covering assembly which includes a first and second generally parallel spaced apart vertically extending sheer fabrics having a plurality of spaced generally parallel transversely extending vanes fixedly secured to the first and second sheer fabrics to extend therebetween.

The sheer fabrics are often constructed of a translucent or transparent material and may be in the form of woven or knitted fabrics or non-woven fabrics or indeed may simply be sheets of plastics material. The vanes are usually opaque or semi-opaque and by adjusting the relative positions of the sheer fabrics, the vanes can be caused to tilt relative to the sheer fabrics rather in the manner of the slats of a horizontal or vertical blind. Conventionally the vanes extend horizontally in such assemblies and the sheer fabrics are supported on a tilt roll which can also be used as a wind up roll. Also known are vertical venetian blinds in which the individual vanes extend vertically; such assemblies have a head rail for opening and closing the assembly and for tilting the vanes when the assembly is in the closed position covering the opening.

SUMMARY OF THE INVENTION

It is a primary object of the present invention to provide a novel covering assembly that will have all of the attributes and advantages of a vertical blind while having all the attributes and advantages of drapery.

The foregoing is accomplished by providing a vertically oriented fabric assembly with front and rear sheers and vertically disposed vanes extending therebetween. A unique carrier system supports the front and rear sheers to enable them to shift from a maximum light admitting orientation to a minimum light admitting orientation by rotating the vanes about vertical axes. The carrier system also enables the panels of the assembly, defined as a vane and the juxtaposed portions of the front and rear sheers, to collapse and fold up upon themselves much like conventional drapery. A further important feature of the present invention is that the front and rear sheers should have diagonal stability so that when the vanes are operated, by one means or another, at the top, the diagonal stability ensures that the vanes operate equally well at their bottoms.

Other and further objects and advantages of the invention will be fully understood and appreciated from the following detailed description of preferred embodiments of the assembly of the invention with reference being made to the accompanying drawings.

BRIEF DESCRIPTION OF THE DRAWINGS

FIG. 2O is a view similar to FIG. 18 of a still further embodiment;

DETAILED DESCRIPTION OF PREFERRED EMBODIMENT

Figure 1:
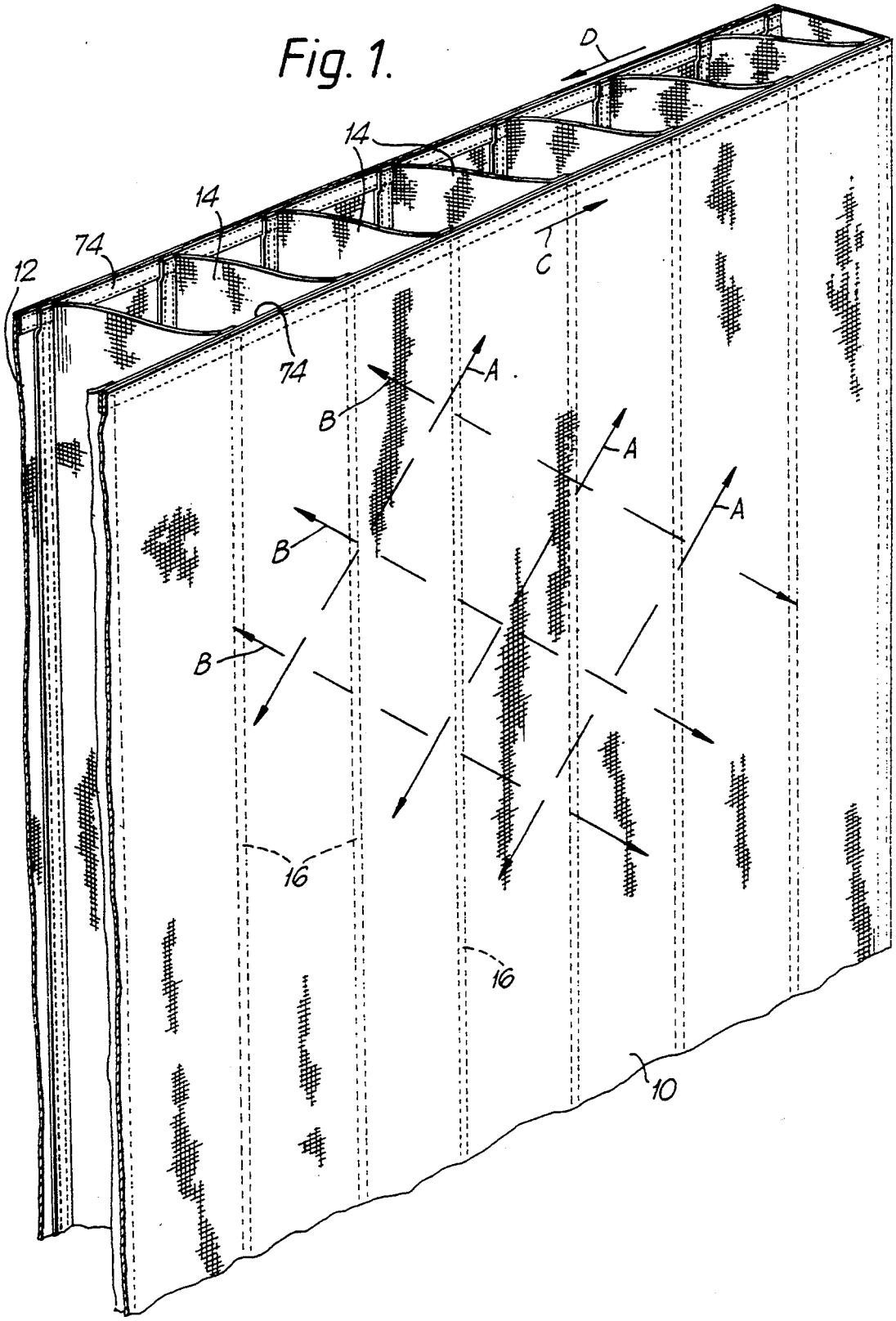
FIG. 1 is a schematic perspective view of one embodiment of fabric light window covering used in a light control assembly of the present invention.

A fabric light control window covering (FIG. 1) comprises first (front) and second (rear) parallel translucent or transparent fabric sides or faces 10,12 and a plurality of opaque or semi-opaque vanes 14 extending between the fabric sides with the vanes being angularly controllable by relative movement of the fabric sides. The fabric sides are preferably sheer fabrics and will be so referenced hereafter.

The window covering has a neat and uniform construction and outer appearance in all degrees of light control. The light control vanes are bonded to the sheer fabric utilizing linear application of a suitable adhesive along straight lines 16 (bond lines) and, thus, a high degree of controllability of the adhesive application process and bonding of the vane is obtained. The precisely uniform construction improves the operation of the covering by preventing warps or distortions from developing over its life.

The covering operates with a high degree of repeatability, that is, always returns to the same appearance when closed. Thus, a feature of the present invention is attachment of the vanes to the sheer fabric sides such that the vanes tend to bias the window covering toward the minimum light admitting position. A further feature of the invention in this respect is a novel heat setting of the three layers together in order to provide a uniform and wrinkle-free shade at any temperature in subsequent use. These features allow the window covering to maintain its original shape and appearance even in the presence of temperature extremes encountered in a window environment.

Accordingly, a fabric light control shade (door or window covering) according to the present invention comprises a first sheer fabric sheet, a second sheer fabric sheet disposed parallel to the first sheet, and a plurality of relatively opaque fabric vanes adhesively bonded transversely between the sheet fabrics. Each vane has a edge portion bonded to the first sheet and an opposite edge portion bonded to the second sheet in a manner tending to bias the first and second sheets together. The window covering according to the present invention is adjustable between a closed position, minimum or no light entry, preferably no see through, and an open position, maximum light entry. The closed position is characterized by a central portion of the fabric strips being substantially parallel to the first and second sheer fabric sheets with the strips themselves being substantially planar; in this position, the front and rear sheets with vanes sandwiched therebetween are collapsed together. The open position is characterized by the central portion of the fabric strips being substantially perpendicular to the first and second fabric sheets and to the bonded edge portions of the strips themselves; in this position the front and rear sheets are spaced apart the maximum distance. Also, characteristic of this position is that portions of the strips between the bonded edge portions and central portions form smoothly curving surfaces which are free of creases or sharp folds. In an alternative embodiment, the central portions of the fabric strips are substantially flat and longitudinally extending hinge or flex points are provided parallel to the bonded edge portions. The covering is adjustable between the two positions by relatively shifting the front and rear sheets 10,12. This action moves them closer and closer together until they are collapsed together. In intermediate positions the light control is achieved.

When the window covering material is in a fully open, light admitting position, each vane has a central portion which is substantially perpendicular to the first and second sheer fabrics. Edge portions of the vanes, which are bonded to the sheer fabrics, are connected to the central portion by transition portions having a smoothly curving shape. The adhesive bonding of the vanes allows formation without creases or sharp folds. The smoothly curved nature of these transition portions, in the fully open position, allows the vane to retain its resiliency and thus tends to bias the sheer fabrics into a closed or drawn together position. This ensures that the window covering does not lose its shape over time from repeated opening and closing. Furthermore, creases along the vanes can develop into failure points due to repeated bending inherent in the opening and closing of the window covering.

Moire effect must be avoided in the window covering. Although sheer woven fabrics having small interstices between the fibers provide a pleasant and desirable appearance for the first (front) and second (rear) sheer fabrics, when the same or very similar material of this type is used for the first and second sheer fabrics, a moire pattern is created by the fabrics when viewed in overlaying relationship due to light interference effects. This moire effect is eliminated in the present invention by providing for the first and second sheers woven and preferably knit fabrics of materials having differently sized, shape and/or oriented interstices. According to the present invention, the moire effect is also avoided by using a non-woven sheer material as one or both of the first and second fabrics or by using a transparent plastic material as one or both of the first and second fabrics.

To avoid the undesirable moire effect when the first and second sheets of woven or knit material are viewed in overlying relation in the window covering of the present invention, the first and second sheers must have different appearances when the sheer panels are viewed along an axis perpendicular to the planes of the first and second sheer fabrics. The required difference in appearance between the first sheer and the second sheer can be achieved in several different ways.

The first or front sheer 10 can be a woven or knit fabric having interstices of one shape and size and the second or rear sheer 12 can be a woven or knit material having interstices of a second shape and/or size and/or orientation. For example, the threads of the first sheer may run at an angle in the range of 30° to 60° relative to vertical but in the preferred form run at an angle of 45° relative to vertical. The threads of the first sheer, by way of example, may run diagonally, forming diamonds, whereas the threads of the second sheer may run orthogonally forming squares. With this relationship between first and second sheers, the appearance of a moire pattern can be avoided. Also, as described in more detail below, it is desirable that both sheer fabrics should have dimensional stability on the bias or diagonal.

It is also possible to avoid the moire effect and provide the required difference in appearance by using a non-woven sheer material, such as a plastic film material, for one of the sheers and a woven or knit material for the other of the sheers of the covering. Alternatively, non-woven sheer materials, such as those formed from the same or different plastic fibers, can be used for both the first and second sheers. A translucent or transparent plastic film material can also be used as the first and/or second fabric. The use of a transparent material for at least one of the first and second fabrics also avoids the moire effect.

To achieve a suitable structure of the vanes, the vane material must have a certain degree of softness. As a general principle, the wider the vanes 14, the stiffer the vane material can be. However, since a broad range of vane widths may be employed in window coverings in accordance with the present invention, it is difficult to precisely define an acceptable softness or stiffness range for the vane material.

A simple and effective physical test has been devised to determine whether a particular fabric is suitable for vanes having a specific vane width. The fabric being tested is allowed to hang over the edge of a table such that the distance from the edge of the fabric to the table top equals the desired vane width. If this width of fabric hangs substantially vertically, then it has sufficient softness for a vane of that vane width. For example, if a fabric is being tested for use as a 50 mm wide vane, the edge of the fabric is extended 50 mm beyond the edge of the table. If the extended 50 mm of the fabric hangs substantially vertically from the table edge, it is suitable for use as a 50 mm wide vane material. If the extended 50 mm of the fabric does not hang substantially vertically, the fabric is too stiff to produce 50 mm wide vanes having the gently curved appearance.

Stiffer fabrics, i.e., those which do not hang substantially vertically over a table edge at the length of the desired vane width, can also be used as the vane material. However, if a stiffer fabric is used for the vanes, longitudinally extending hinge or flex points must be provided along the edges of the vanes. The use of a stiffer fabric provided with hinge points produces a covering having a somewhat different appearance. In these circumstances, vanes have a straighter appearance and have a sharp bend at the hinge points, rather than a gently curving portion. The hinge points may be provided by score-compressing a stiff vane material, parallel to the longitudinal edges of the vane material. The score-compressed lines formed in the stiff vane material are spaced apart from the longitudinal edge of the vane material a distance sufficient to allow adhesive lines to be applied to the vane material between the longitudinal edge of the vane material and the score-compressed line.

A structure of the above type can also be produced by using a soft vane material as previously described. In this embodiment, a stiffening agent is printed on the vane material in the central portion thereof to provide flatter vanes. The longitudinal edges of the vane material are left free of stiffening agent and the required hinge points are formed at the longitudinally extending edges of the printed on stiffening agent. The adhesive lines are applied to the longitudinal edges of the vane material, which longitudinal edges have been left free of stiffening agent.

According to another embodiment of the present invention, the vanes are formed of a black-out laminate material to maximize the room darkening effect of the window covering when the vanes are oriented in the closed position. A suitable black-out laminate material is a three play laminate comprising a polyester film such as MYLAR sandwiched between two layers of a spun bonded or spun laced polyester non-woven material. Such a three play laminate has, by virtue of its construction, a greater stiffness than most single ply materials. Accordingly, score-compressed hinge points could be provided in the black-out laminate vane material if necessary.

Alternatively, to produce a covering of the present invention having a maximized room darkening effect, only a stiffened central portion of the vanes is formed from a black-out laminate material. The longitudinal edges of the vanes are left free of the black-out laminate to provide the required hinge points and flexibility along the edges of the vanes. When the black-out laminate is provided only on the central portion of the vanes, it is desirable to space the vanes closer together than described above in order to ensure that the black-out laminated central portions overlap when the covering is closed, for maximum room darkening effect. For example, for a 63.5 mm wide vane with a 38 mm wide black-out laminated central portion, the overlap of the vanes is preferable about 13 mm.

Another possible vane material is vinyl or a laminate of a non-woven material and a vinyl material. Generally, vinyl materials and laminates of non-woven material and a vinyl material provide an increased room darkening effect but are soft enough that score-compressed hinge points are not required. Of course, score-compressed hinge points could be provided if necessary.

As discussed with respect to the first and second sheers of the covering, when two woven fabrics are viewed in an overlaying relationship, an interference pattern or moire effect can result. When a non-woven fabric is used for the vane material, the problem of a moire effect in the covering when it is closed is avoided. In some instances, however, it may be desirable to use a woven or knit material for the vane material. A basic woven material will give a moire effect because this type of material has a very ordered orthogonal surface structure. To avoid a moire effect when the covering, having a woven or knit vane material, is in the closed position, a crepe woven materials can be used as the vane material because crepe woven materials have a much more randomly oriented surface structure. Alternatively, the surface of the woven or knit material can be altered to randomize the surface fibers, for example, by sanding, napping or calenderizing.

Coverings having first and second sheer fabrics and vanes of various colours, and combinations of colours are contemplated within the scope of the present invention. For example, to provide a more transparent covering in the open position, dark sheer material can be used for the first and second sheers because dark colours reflect less light than lighter colours. Similarly, white or light coloured sheer materials provide a more translucent effect when the covering is open.

The vanes may be the same colour or a different colour than the first and second sheer fabrics. A problem of glue line show-through has been experienced, however, when the vane material is a dark colour and the first and second sheer fabrics are of a considerably lighter colour or white. To overcome the problem of a dark glue line showing through a light coloured sheer material when the vane is adhesively bonded to the first and second sheer fabric of the covering, a small amount of whitener, about 0.5 to 1.0% by weight, is added to the adhesive before it is applied to the vane material. A particularly suitable whitener is titanium dioxide. The addition of this whitening pigment to the adhesive eliminates the problem of dark coloured glue lines being visible in a covering wherein a dark coloured vane is adhesively bonded to a lighter coloured sheer fabric. Also, the addition of titanium dioxide to the glue can be a way to dull the glue lines.

With respect to the vanes, it has been unexpectedly found that by increasing the machine-direction or lengthwise tension on the material prior to and during application of a binder composition, the machine-direction stiffness of the treated fabric is advantageously and significantly increased with a slight decrease in cross-direction stiffness of the treated fabric. The strips used for the vanes are cut from the treated fabric. A high ratio of machine-direction stiffness to cross-direction stiffness is desirable in the treated fabric, particularly when the treated fabric is to be fabricated into vanes. Depending upon the type and number of yarns in the woven textile material, the ratio of machine-direction stiffness to cross-direction stiffness for treated fabric according to this invention can range from between about 3:1 to 50:1, or more.

Increasing the machine-direction tension on the woven material while allowing neck down or letting the fabric go slack in the cross-direction causes the warp yarn filaments to draw in tightly and then the applied binder composition bonds these warp yarn filaments together such that the bonded filaments act as one much stiffer yarn. The lack of tension in the cross-direction allows the fill direction filaments to remain fluffy and, therefore, to not bond as easily to one another when the binder composition is applied.

In this process of treating the woven textile material to produce the treated fabric for the vanes, the fabric is treated with a low percentage (up to about 5%) by weight solids add on of a binder composition. The preferred binder composition is applied to the woven textile material in an amount of about 2% by weight solids add on.

The binder composition with which the woven textile material is treated can be any composition known to those skilled in the art capable of filling the interstices in the woven textile material to bind the individual fibers. Examples of suitable types of binder compositions include elastomers which are capable of binding the individual fibers of the woven textile material and which are resistant to ultraviolet (UV) radiation and to breakdown or degradation due to other environmental factors. Especially preferred compositions are elastomeric acrylics and elastomeric urethane-type compositions.

The maximum spacing of the front and rear sheers is dependent on the vane width. According to the invention vane widths of 50 to 150 mm before assembly are used but 63.5 to 100 mm widths are preferred. In the best mode for carrying out the invention the maximum spacing between the front and rear fabrics is 67 mm using vanes 89 mm wide with 76 mm spacing between successive vanes to achieve an appropriate vane overlap.

It is also desirable for both sheer fabrics 10 and 12 to have dimensional stability generally in the bias or diagonal lines as indicated by the arrows A and B in FIG. 1. The reason for this is as follows.

In a window covering of this nature, the covering is opened and closed by moving the front and rear sheer fabrics 10 and 12 horizontally relative to each other, conveniently by forces which are applied to the top edges of the respective sheers by actuators, or the like yet to be described. When the covering is being closed, the sheers are moved in the horizontal directions indicated by arrows C and D. During this operation, to provide effective closure of the vane over the entire height of the covering, the front sheer 10 should be dimensionally stable diagonally, i.e., in the direction of arrows A, and the back sheer 12 should also be dimensionally stable diagonally, i.e., in the direction of arrows Conversely, when the covering is being opened and the sheers are moved horizontally in directions opposite arrows C and D, in order to insure uniform twisting of the vanes from top to bottom, the front sheer 10 should be dimensionally stable in the direction of arrows B and the 15 back sheer 12 should be dimensionally stable in the direction of arrows A.

Figure 1A:
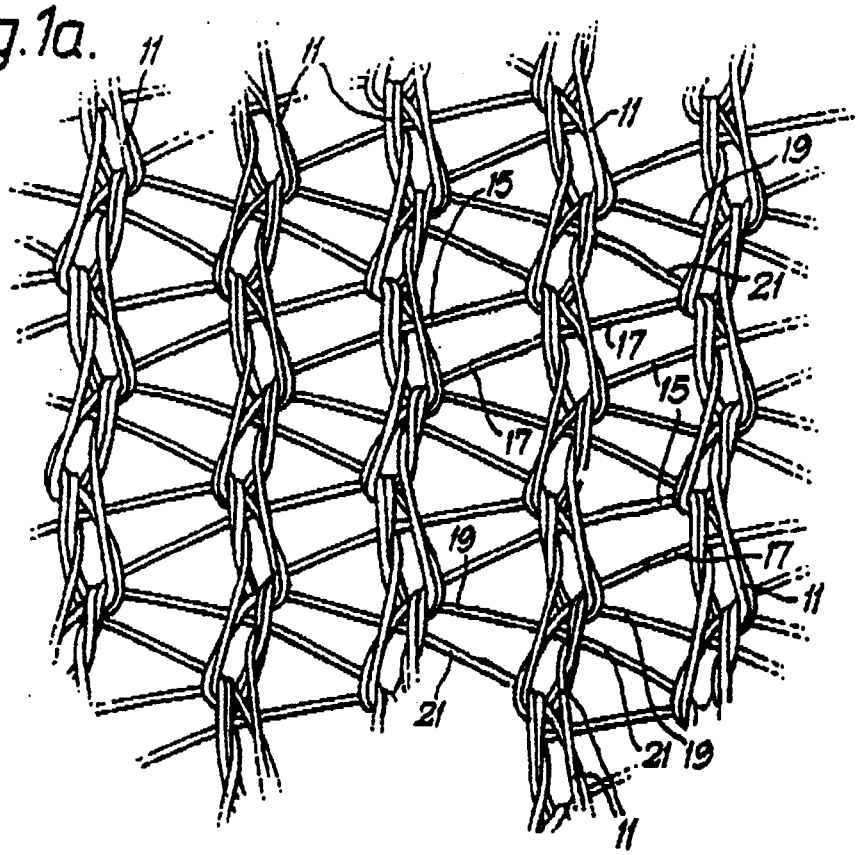
FIGS. 1*a* and 1*b* show (as viewed under the microscope) two different forms of sheer fabric material suitable for use with the assembly of FIG. 1.
Figure 1B:
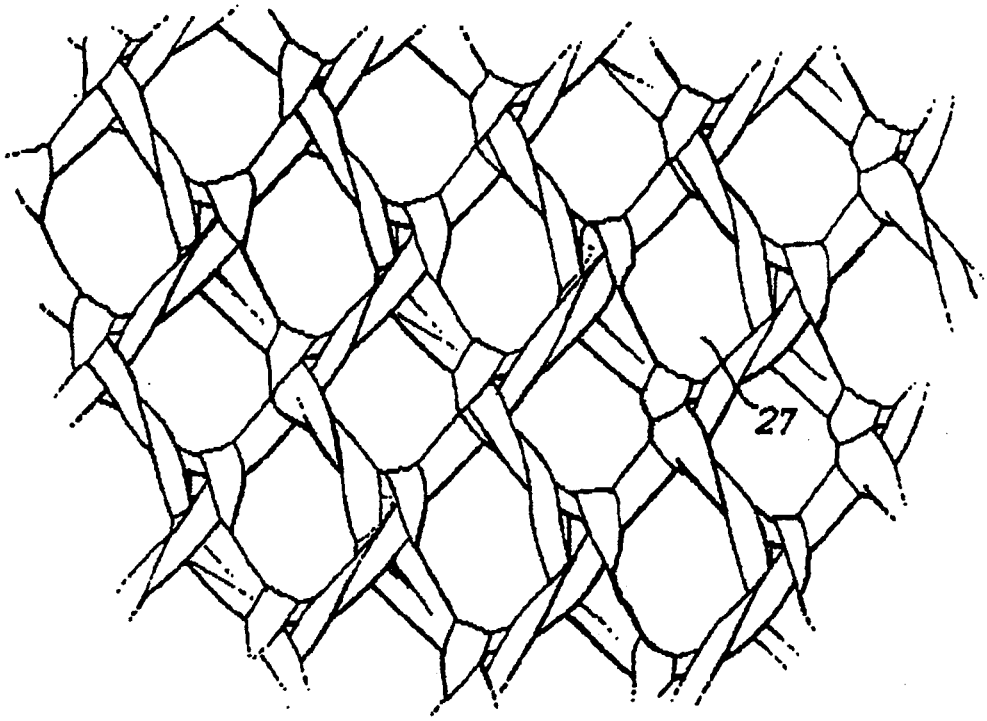

The diagonal stability referenced above can be obtained from knitted fabrics and such fabrics are preferable for use in the present invention. Knitted fabrics can be formed in numerous configurations including those where the knitted yarns run diagonally of the fabric and thus promote the desired stability. Commercially available knitted patterns are illustrated in FIGS. 1*a* and 1b and either would be suitable for use in the present invention. By utilizing the knitted pattern of FIG. 1*a* for the front or the back sheer and the knitted pattern of FIG. 1*b* for the other sheer, the undesirable moire effect can be avoided.

This can be best achieved by having the front sheer 10, i.e., that facing the interior of the room, formed of a knit material such as that illustrated in FIG. 1*b*. This is a tulle-type fabric made on a warp knitter which is characterized by diamond-shaped interstices 27. The diamond shapes effectively counter diagonal forces as well as help to cancel out moire patterns in conjunction with the more orthogonal structure of the rear sheer.

The rear sheer 12, which generally faces the window or outdoors, is best formed of a knit material such as that illustrated in FIG. 1*a*. This type of fabric is also made on a warp knitter. It will be seen that such a fabric, as viewed under the microscope, has a plurality of generally parallel bundles of yarn. These bundles are Joined by a plurality of generally transverse extending very fine yarns 15,17,19,21. These yarns extend diagonally upward and to the right at slightly different angles to the horizontal on one side of each bundle 11 and extend downwardly and to the left, again at these different angles to the other side of the bundles.

The above-described fabric structure produces diagonal dimensional stability to the fabric in the direction of the arrows A and B in FIG. 1 and yet provides considerable lateral softness and longitudinal strength.

The fabric light control window or door covering is to be supported from carriage assemblies 20 (FIG. 2) that have freely rotatably mounted wheels 22 that ride on tracks 24 defined by a conventional drapery track generally designated as 26. The main body 28 of the carriage is a plastic molded body in which is held a bearing for a gear 30, easily pushed into the body, and is in meshing engagement with a worm 32 journaled in body 28 and operated by a splined tilt rod 34 which extends through the worms of all the carriers. Rotation of rod 34 via a wand, cord 35 (FIG. 13), or the like drives worm 32 causing worm gear 30 to rotate. Optionally, a stop may be included to confine worm gear 30 to less than 360° rotation. All of the above is conventional and may be seen, e.g., in U.S. Pat. No. 4,648,436, which disclosure is here incorporated by reference. Spacers, not shown, are mounted to assemblies 20 in a conventional manner via a slot in body 28 and to a cord 29, spindle or the like in a conventional manner to effect the conventional drawing action to spread out the carriage assemblies 20 along the track or to gather them at one end. Alternatively, a conventional scissors arrangement can be used to replace the spacers. Furthermore, the spacer or scissors arrangement may be omitted so that the front and rear fabric define the distance between carriers when the light control covering is in its expanded condition.

A threaded shaft 40 is fixed to worm gear 30 and extends below or depends from the main body 28 via bearing projection 31 and has an L shaped actuator control element 42 fixed thereon by a nut 43 holding the horizontal leg of element 42 fixed to shaft 40. Shaft 40 extends further downwardly passing freely through an actuator arm 44 and has a pair of nuts 46 threaded onto its lower end to lock and establish a stop and provide height adjustment.

Arm 44 extends for a distance at least equal to the maximum opening of the covering, e.g., 67 mm and at either end is connected with a hanger or an attachment member 50 consisting of a paddle like lower end having a hole 52 adjacent its lower free end and an upper end that is freely pivotally mounted in the end of arm 44 by any conventional mounting means. A spring 58 is fixed at one end to the arm 44, such as by passing through hole 54 in arm 44 and being bent or crimped. The other end of spring 58 is fixed to the depending leg of actuator element 42 in a like manner. When splined tilt rod 34 is actuated and drives worm 32, worm gear 30 via element 42 and spring 58 will cause arm 44 to rotate around shaft 40.

Figure 3:
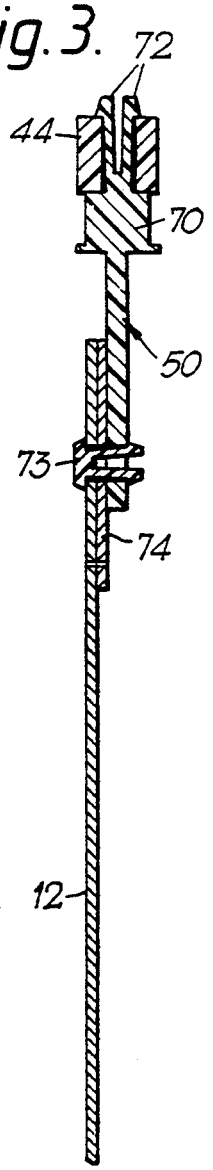
FIG. 3 is a schematic side elevation showing how a sheer fabric is mounted on a hanger of a carrier of FIG. 2.
Figure 4:
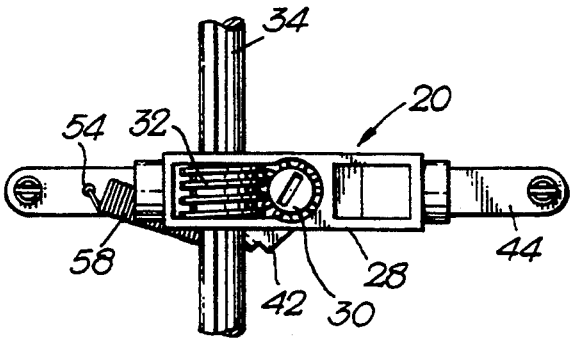
FIG. 4 is a plan view of a carrier of FIG. 2.
Figure 5:
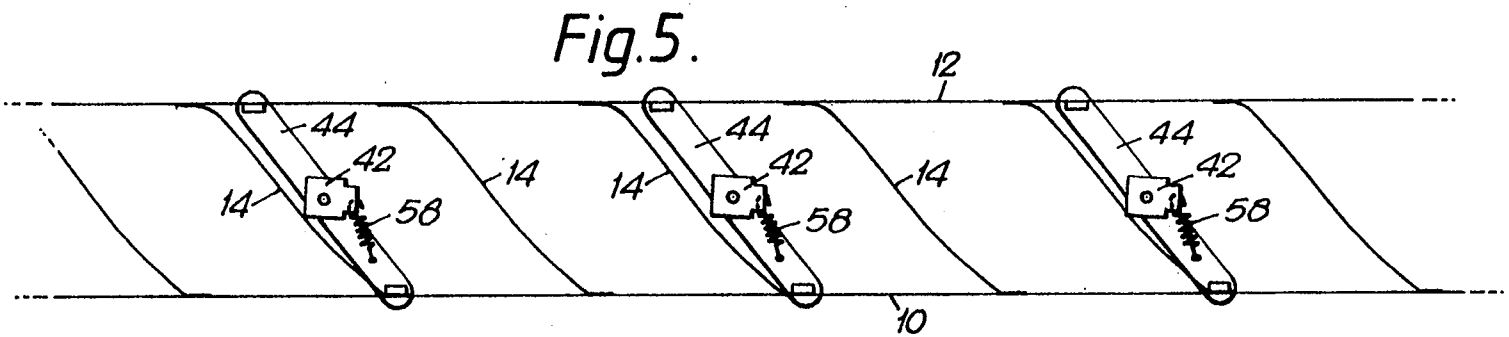
FIG. 5 is a schematic top plan view showing the fabric covering open and where the hanger of the carrier is attached to the sheer fabric.

Hanger 50 may consist of a body 70 in the form of a T with a pair of deflectable spaced headed or barbed connectors 72 extending upwardly from the top of the cross bar of the T for insertion into the hole at the end of arm 44 as shown in FIG. 3. A hole at the lower end of the depending leg of the T cooperates with a pin 73 having a pair of spaced deflectable barbed heads. As shown in FIG. 5, the light control covering is mounted on the arm 44 by attaching one hanger 50 to the front sheer, on its inside face precisely at the glue joint formed between a vane and the front sheer. The other hanger 50, at the other end of arm 44 is attached to the inside face of the rear sheer at a point displaced from the glue joint for the same vane in the direction toward the front sheer attachment for that vane. The top inside edge of the front and rear sheers can be provided with a reinforcing strip 74 so pin 72 can clamp the top edge of the sheers to hangers as shown in FIG. 3.

Figure 9:
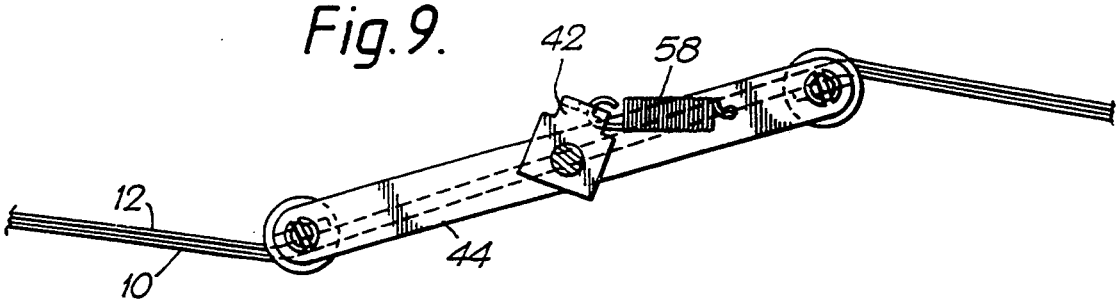
FIG. 9 is a schematic top plan view showing the over-closed position of FIG. 7 in enlarged detail.
Figure 6:
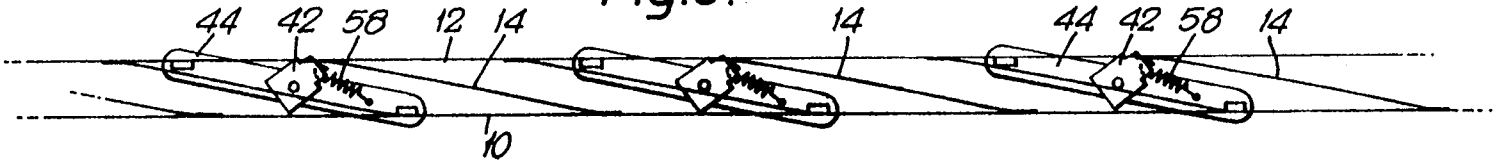
FIG. 6 is a schematic top plan view showing the fabric covering nearly closed.
Figure 7:
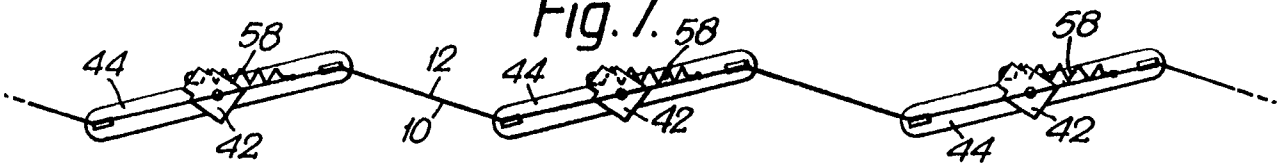
FIG. 7 is a schematic top plan view showing the fabric covering-over-closed.

The light control covering is mounted over a window with its vanes extending vertically. Actuator arms 44 of the respective carriers 20 are preferably attached to the covering for every other vane as shown in FIG. 5, which shows the covering fully extended over a window or other opening and in the open position (maximum light passage). Alternatively the carrier may be provided at every third or fourth vane. To move the covering to the closed position as shown in FIG. 6, the tilt rod is rotated, driving each worm 32, worm gear 30, shaft 40 and rotating each actuator 42 which in turn, through spring 58, carries arm 44 around shaft 40 bringing the covering to its closed position. At this time, since there is little resistance to rotation of arm 44, spring 58 is not substantially extended or loaded. This condition continues as the covering approaches the closed condition shown in FIG. 6 and proceeds through the closed condition to an over-closed position shown in FIG. 9. The net effect will be slight over-travel of the closed position with the panels (a vane sandwiched between front and rear sheers) now slightly tilted out of the plane of the normally closed plane. Then the resistance to further rotation of the arms 44 caused by the fabric layers having closed on one another becomes greater than the force of the springs 58. Thus, continued rotation of actuators 42 extends and tensions the springs until the actuators 42 engage arm 44 as shown in FIG. 7.

Figure 8:
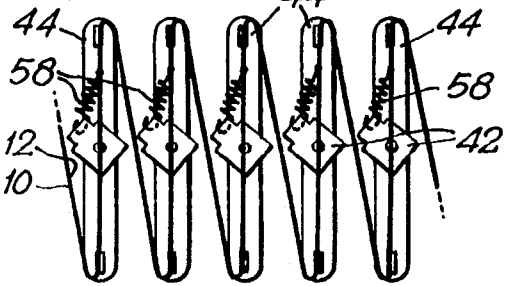
FIG. 8 is a schematic top plan view showing the fabric covering collapsed or drawn back state.

When the extension of the covering in the over-closed position (full extension of carriers 20) is relieved, as the covering is drawn to the retracted position (gathering of carriers 20 at one end) and retracted from covering the window successively, the pressure on arms 44 exerted by the extended fabric is released and the springs 58 will draw the arms 44 around to the substantially parallel positions shown in FIG. 8 and cause successive panels to collapse and fold upon themselves in substantially parallel folds.

Where the fabric itself or spacers define the distance between adjacent carriers when the light control window covering is in its expanded condition, the carriers are not all moved at the same time to the retracted position of the light control window covering. A first carrier is moved towards an adjacent second carrier by means of a cord, spindle or the like. When the first and second carriers abut, the first carrier moves the second carrier towards the next carrier adjacent to the second carrier, and so on. The panels of the already abutting carriers will be folded upon themselves whereby the remaining panels will still be in the slightly over-closed position. Consequently, the panels are successively collapsed and fold upon themselves.

Where a scissor arrangement is used, all carriers are moved to the retracted or stacked position at the same time. Again, the movement is initiated by a cord, spindle or the like which acts on a first carrier whereby the scissor arrangement will cause the other carriers to move upon movement of the first carrier. Consequently, all of the panels will gradually collapse and fold upon themselves at the same time.

The springs 58 store rotational energy in the actuator arms 44 when the sheers have been closed upon themselves and release the stored energy when the covering is retracted across the window opening causing the panels to fold neatly on themselves with the actuator arms 44 all parallel and perpendicular to the track rail 26.

In a preferred embodiment, the actuator arms are 74.6 mm long and the hangers for holding the top edges of the front and rear sheers are 76.2 mm wide outside-to-outside or approximately equal to the vane spacing of 76.2 mm for 88.9 mm vanes. Because of the S shape or curving of the vanes and because the hangers are not parallel to the vanes, the maximum spacing of the front and rear sheers is, by way of example, 66.7 mm. Most of the components noted in the above description are injection molded plastic parts.

The front fabric may be polyester of about 23.7 gm/m$^2$ (from about 4.7–47.5 gm/ml) and is a tulle knit with a diamond pattern. The rear fabric may also be polyester of the same weight and is a warp knit with diagonal threads and has an orthogonal pattern. The principal characteristic of the rear fabric is the necessity for stability on the bias or diagonal. The vanes are a woven polyester of a weight of 47.5 gm/m$^2$ (about 24–95 gm/m$^2$) weight. The vanes are preferably opaque but may be translucent for privacy. A stiffener tape is attached to the inside top edges of the front and rear fabrics to enable reinforcement to be able to hang the fabrics on the hangers depending from the actuator arms. Grommets could be used for this purpose, if desired. Weights (about 15 gm weight) are attached to the bottom edge portions on the inside of every other vane at its front and rear portions directly below the attachment points to the hangers, one 15 gm weight per specified location.

Figure 13:
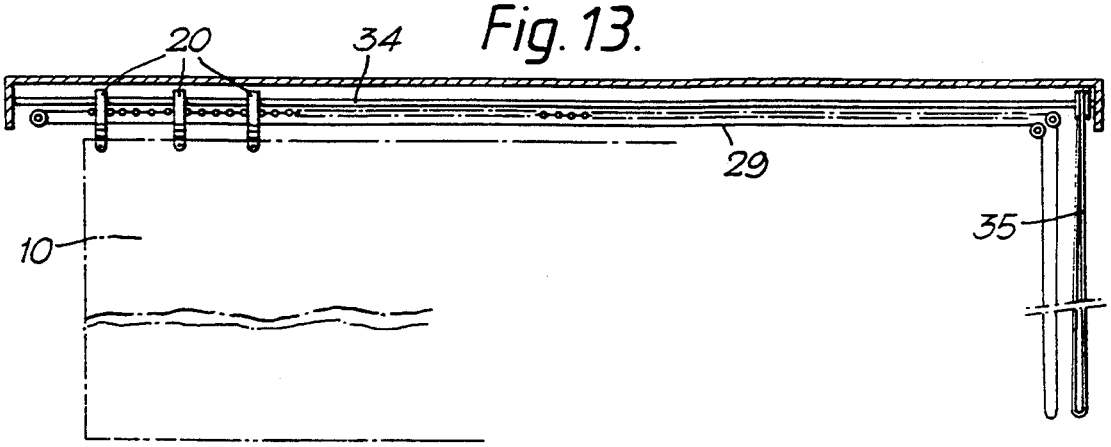
FIG. 13 is a schematic showing cords for moving carriers and a tilt rod.

The tilt rod can be operated by a wand or by one or two pull cords 35 as already known in the art, see FIG. 13. Also, the carriers or carriages may be associated with spacers which can be metal strips that fit through slots in the carriers and have stops at each end so the lead carrier can be traversed on the track by a cord arrangement and successively draw out the rest of carriers in appropriate spacing. When retracting the carriers, the lead carrier is drawn back and the strips slip through their slots to allow the carriers to stack at one end. Alternatively a scissors spacer can be used. Both are known and are coupled to the carriers in a known way. When moving the carriers from the retracted or stacked condition of the vanes, the opposite situation arises and the assembly will move firstly from the position of FIG. 8 to that of FIG. 7 and then to that of FIG. 6. Thereafter, if one chooses, one can continue to operate the vanes so that they finish up more or less in the position of FIG. 5.

Figure 10:
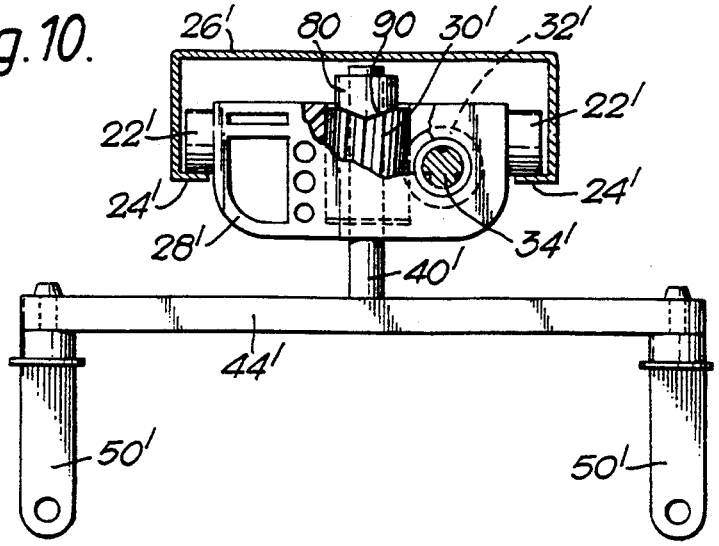
FIG. 10 is an elevational view, part broken away of a modified carrier assembly.
Figure 11:
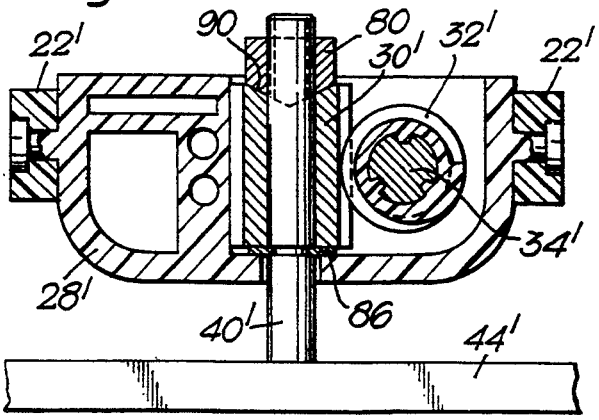
FIG. 11 is a sectional elevational view of the modified assembly.
Figure 12:
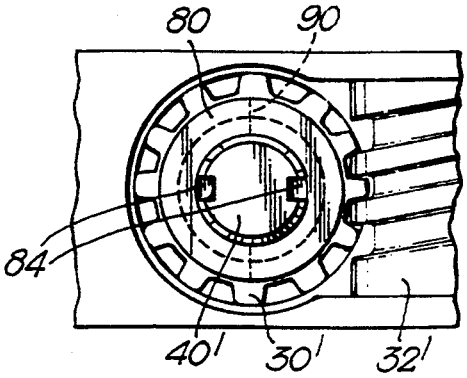
FIG. 12 is an enlarged plan view of the modified assembly.

The carriers can be provided with a coupling management between the drive shaft and the actuator to effect over-closing and a tilt toward collapse with a slight force favouring collapse upon relief, or an arrangement as shown in FIGS. 10–12 whereby a return force is imposed on the actuator arm 44', such as by a weight or cam member 80 riding on top of the worm gear 30' and cooperating or coupling therewith via interfitting inclined camming surfaces 90. In this arrangement where like references are used to denote like parts to those in the previous embodiment, the weight 80 is keyed to the shaft 40' which carries actuator arm 44' by keys 84. The worm gear 30 is freely rotatable about shaft 40 and is retained in the carrier body 28 by a snap ring 86 or the like. When the actuator encounters little resistance in moving from the open position shown in FIG. 5 to the closed position shown in FIG. 6, the worm gear drives the actuator through the coupling formed by the interfitting inclined surfaces 90 on the gear 30' and weight 80. Resistance resulting from over-closing, however, will cause the worm gear to drive the weight up the incline out of coupling engagement with gear 30' and store energy in the weight for driving the actuator when the resistance is relieved by the weight dropping back into register with the inclined surface on the worm gear.

With an arrangement of the type shown in FIGS. 10 to 12, retraction of the light control window covering can be stopped (i.e., in an intermediate position) when some but not all of the panels are collapsed and folded over upon themselves. The non-collapsed panels, which are still in the slightly over-closed condition, can then be used to regulate the light through the panels as previously described whereby the already collapsed panels remain in the collapsed position. A feature of the arrangement of FIGS. 10 and 12 is that the actuator 44' will be lifted during over-tilting.

In a further modified carrier assembly as shown in FIG. 14, where again like references are used to denote like parts, the actuator 44'' is carried by a shaft 40'' depending from a rotary cam 92 in the carrier body 28'' which in this case has a closed top 94. The worm gear 30'' is mounted above the cam for rotation about a shaft 96 and the worm gear and cam have interfitting inclined camming surfaces 90''. A coil spring 98 may be provided to exert downward pressure on the worm gear.

In this arrangement, when the covering is being closed and there is little resistance to movement of the actuator, the cam and actuator are rotated by the worm gear through the interfitting surfaces 90''. When excessive resistance is encountered, as previously, the worm gear will be lifted against the pressure of spring 98, for energy storage. When the resistance is reduced, the spring pushes the worm down back into engagement with the cam, thereby rotating the cam and actuator. Alternatively, the worm gear itself may comprise a weight for energy storage and the spring can be omitted.

Figure 14:
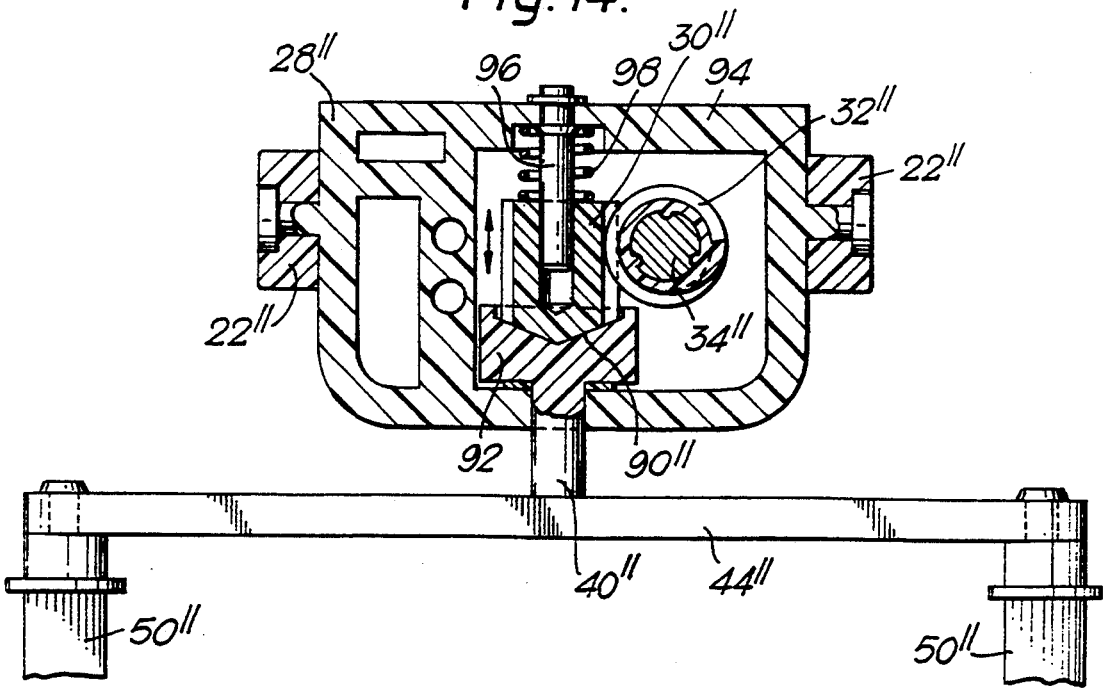
FIG. 14 is a somewhat schematic view of another modified carrier assembly.
Figure 15:
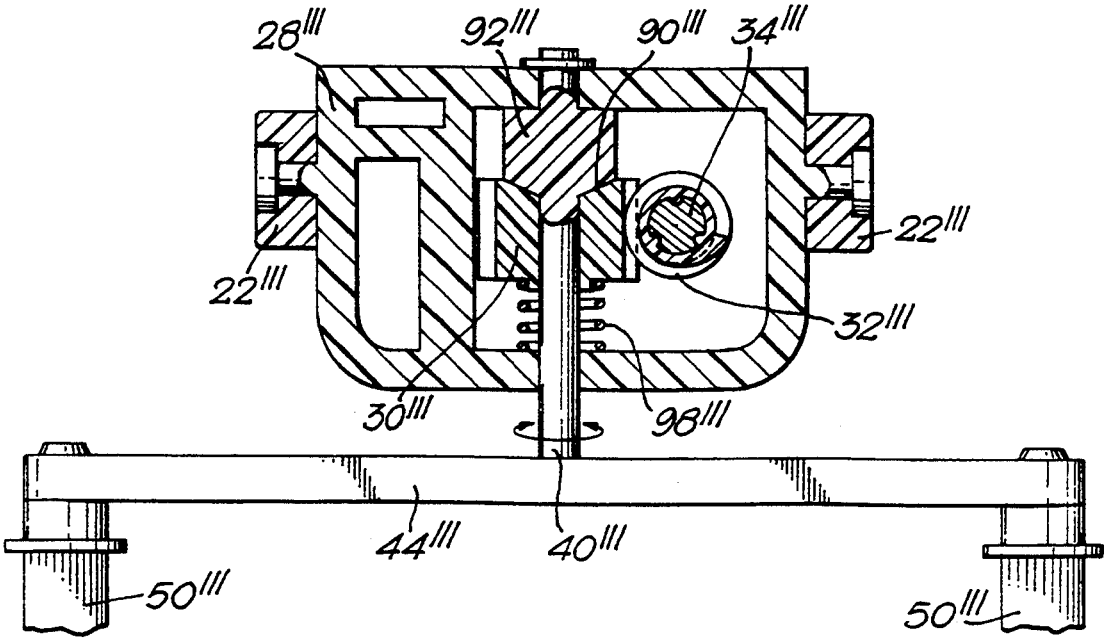
FIG. 15 is a view similar to FIG. 14 of still another modified carrier assembly.

Contrary to the arrangement of FIGS. 10 to 12, the arrangement of FIG. 14 does not lift the actuator during over-tilting. The interfitting inclined cam surface can be so shaped that the holders are naturally returned to a fixed home center position. This arrangement is particularly helpful when one is using a single control or so called "mono-command" arrangement which provides both movement of the carriers and tilting of the vanes. The reason for this is that with this "mono-command" system, when one operates the control with a view to moving the carriers in the opposite direction from previously, the first thing that happens when the panels are in the collapsed position (light control window covering being retracted) is that the vanes are starting to tilt in the direction in which the window covering would give maximum light passage when it is in its fully expanded condition. However, because the vanes are still in their collapsed position and cannot fully tilt towards said maximum light passage condition, the actuators will be loaded in a direction opposite to the direction in which the actuators are loaded when the window covering is in its over-closed position. Once the actuators are all loaded, the end carrier begins to move, thereby allowing subsequent vanes to tilt to their maximum light passage condition whereby the actuators will be unloaded. Hence, when the window covering is moved to its expanded condition the vanes reach the maximum light passage condition. Once the window covering has reached its fully expanded condition the window covering can be closed by operating the mono-command arrangement in an opposite direction. The vanes will close and will all substantially lie in one plane as previously described. Upon further operation of the mono-command system the vanes will over-close and the actuator will be loaded as described earlier. Upon again further operation of the mono-command system the end carrier starts to move towards the collapsed condition of the window covering and the panels will fold in a zigzag way whereby the actuators will become unloaded. The actuators must therefore be capable of loading in either direction so as to enable this operation to take place in either one direction or the other. In a still further modified carrier assembly as shown in FIG. 15, the actuator 44''' is carried on a shaft 40''' rotatably mounted in carrier body 28''' and having a cam 92''' at the top of the shaft. The worm gear 30''' is rotatably mounted about the shaft and interfitting V-shaped camming surfaces 90''' are again provided on the worm gear and cam. The worm gear sits on a coil spring 98''' at the base of body 28'''. In this arrangement, when the resistance to rotation of the actuator becomes excessive, the worm gear is cammed downwardly against the bias of spring 98''' by cam 92''' and when the resistance is decreased the worm gear is sprung back up to re-engage the surfaces 90''' and rotate the actuator 44'''.

The system for operating the opening and closing of the window covering and the system for tilting the hangers may be separated (individual operation) or may be combined in a mono-command system (combined operation), which systems are well known in the art. In the latter case, it will be possible to move the carriers and tilt the hangers by operation of one simple wand, cord or the like. Furthermore, the above operation may be actuated by motor drive means which are operable by means of, for example, a remote control unit.

Experience has shown that there can be a problem that the bottom of the end portion of the window covering tends to move towards the center of the window covering, that is the end edges tend to be not truly vertical, but angled slightly inwardly of the vertical from top to bottom. According to the invention, this may be overcome by providing a facility on the carriers at the ends of the window covering for lifting only the end actuator arms. In fact the problem comes even more acute when the window covering is moved to the position in which the vanes are open, i.e. substantially perpendicular to the sheer fabrics. The invention therefore further provides a facility by further lifting of the actuator arm as the window covering is turned to the open position. One or two carriers according to the construction of FIGS. 10 to 12 may be used at an end location to produce this lifting effect.

Figure 16:
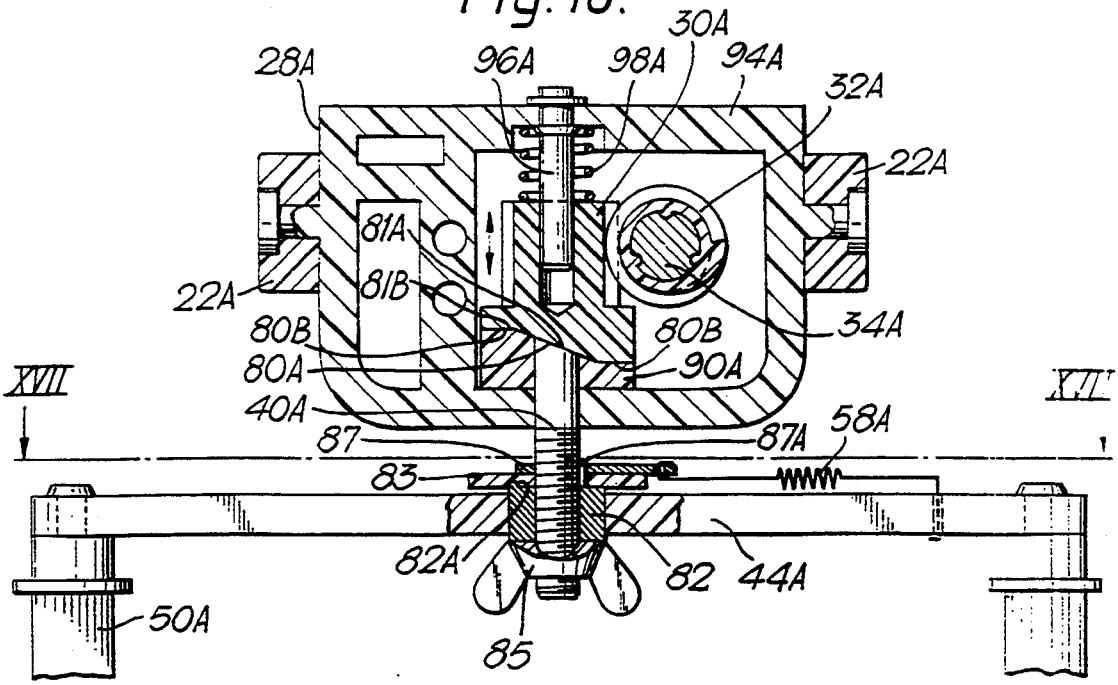
FIG. 16 is a view similar to FIG. 14 of a further modified carrier assembly.

Another structure of carriage suitable for carrying this out is illustrated in FIG. 16 in which like parts have been indicated by like reference numerals to those of FIG. 10, but with the addition of the reference letter A. In this structure the worm gear 30A is again urged downwardly by a spring 98A and is provided with a lower cam surface 80A provided with opposite flat portion 80B. A cam member 90A is fixedly secured to the housing 28A of the carrier and has cam surfaces 81A and 81B complementary to surfaces 80A and 80B respectively. Cam member 90 is of annular form allowing for the passage of the downwardly extending threaded shaft 40A fixedly secured to the worm gear 30A. The actuator arm 44A is provided with a central bearing sleeve 82, preferably of metal, which is freely rotatable about the threaded shaft 40A.

Figure 17:
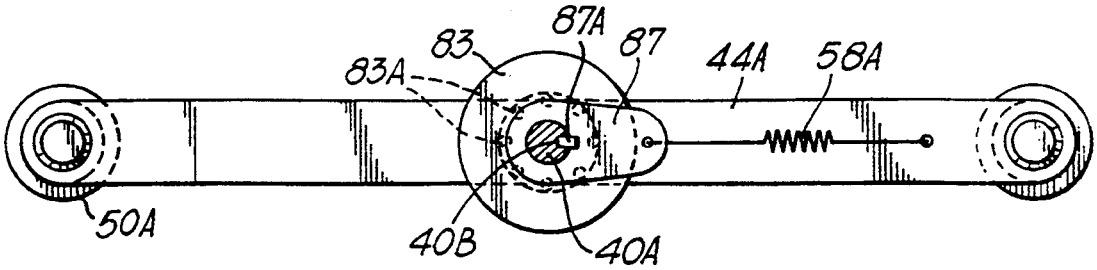
FIG. 17 an fragmentation plan view on the line XVII—XVII the carrier assembly of FIG. 16.

Threaded onto the shaft 40A is a locking ring 83, the lower surface of which bears against the upper surface of the bearing sleeve 82. This sleeve is provided with an upwardly extending projection 82A which is capable of being engaged in one of a plurality of circumferentially spaced indentations 83A in the lower surface of the ring 83. (See FIG. 17).

Located below the bearing ring 82 is a wing nut 85 which can be screwed up to bear against the lower surface of the ring 82.

Mounted above the wing nut 83 is a spring holding plate 87 having an aperture therein for the passage of the shaft 40A, the latter having a key way 40B engaged by a key 87A on the plate 87. In this way the plate 87 is caused to rotate with the shaft 40A. A spring 58A is connected to the plate 87 as shown and also to the arm 44A.

In order to initially adjust the height of the arm 44A the wing nut 85 is loosened downwardly which enables the locking ring 83 to be rotated. In this way, if it is rotated upwardly, then when the wing nut is again tightened, the arm will be raised to a higher level. By use of a wing nut and a knurled locking ring 83, this operation can be carried out readily by the installer.

When the vanes carried by the arm 44A are turned to a direction perpendicular to the sheer fabrics, the cam surfaces 80A and 81A will ride up one another to give a further raising of the arm 44A. The fully opened position will be determined by the flats 80B and 81B engaging one another. If necessary, a suitable ridge and groove can be provided in these flats to determine accurately the perpendicular position of the vanes. When the blind is moved back to the closed position of the vanes, the cams will be such as to allow the worm gear 30A to fall again, thereby lowering the arm 44A, progressively as the vanes move to the closed position. The spring 58A will operate as previously.

Figure 2:
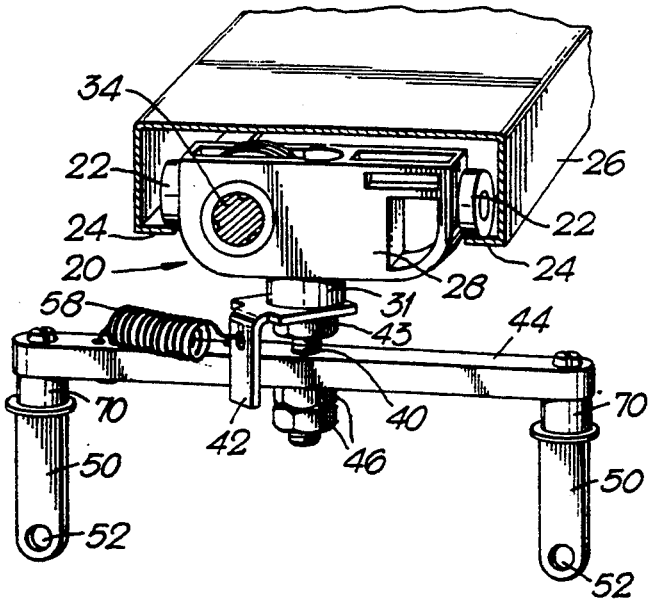
FIG. 2 a perspective view of a head rail and one embodiment of carrier used for mounting the covering of FIG. 1.

However, it will be noted that because there is no equivalent to the down turned portion of the element 42 of FIG. 2, the arm 44A can move equally in either rotational sense and the provision of a plate 87 keyed to the shaft 40A, the spring 58A will provide a fixed home center position for the arm 44A and thus of the associated vane.

An alternative to the spring 58A and plate 87 would be a C shaped spring having its center portion secured to the shaft 40, 40A and its side arms engaging one on each side of the arm 44, 44A. This again will provide for a fixed home center position.

In one structure according to the invention, instead of providing for the end vane of any of the blinds described above to be capable of being turned, provision for a fixed support member can be made so that each end vane is always fixed in the "open" position, i.e. perpendicular to the sheer fabrics. This can assist in ensuring that the window covering stacks neatly as shown in FIG. 8, as the covering is drawn back to the fully open position. It is particularly useful when the covering for a window comprises two parts, one which is stacked to the left of a window and the other to the right, as with conventional curtains or drapes.

It is also contemplated that, as an alternative, the vanes could be controlled so that they remain closed as the window covering is expanded towards the closed window covering position.

Figure 20:
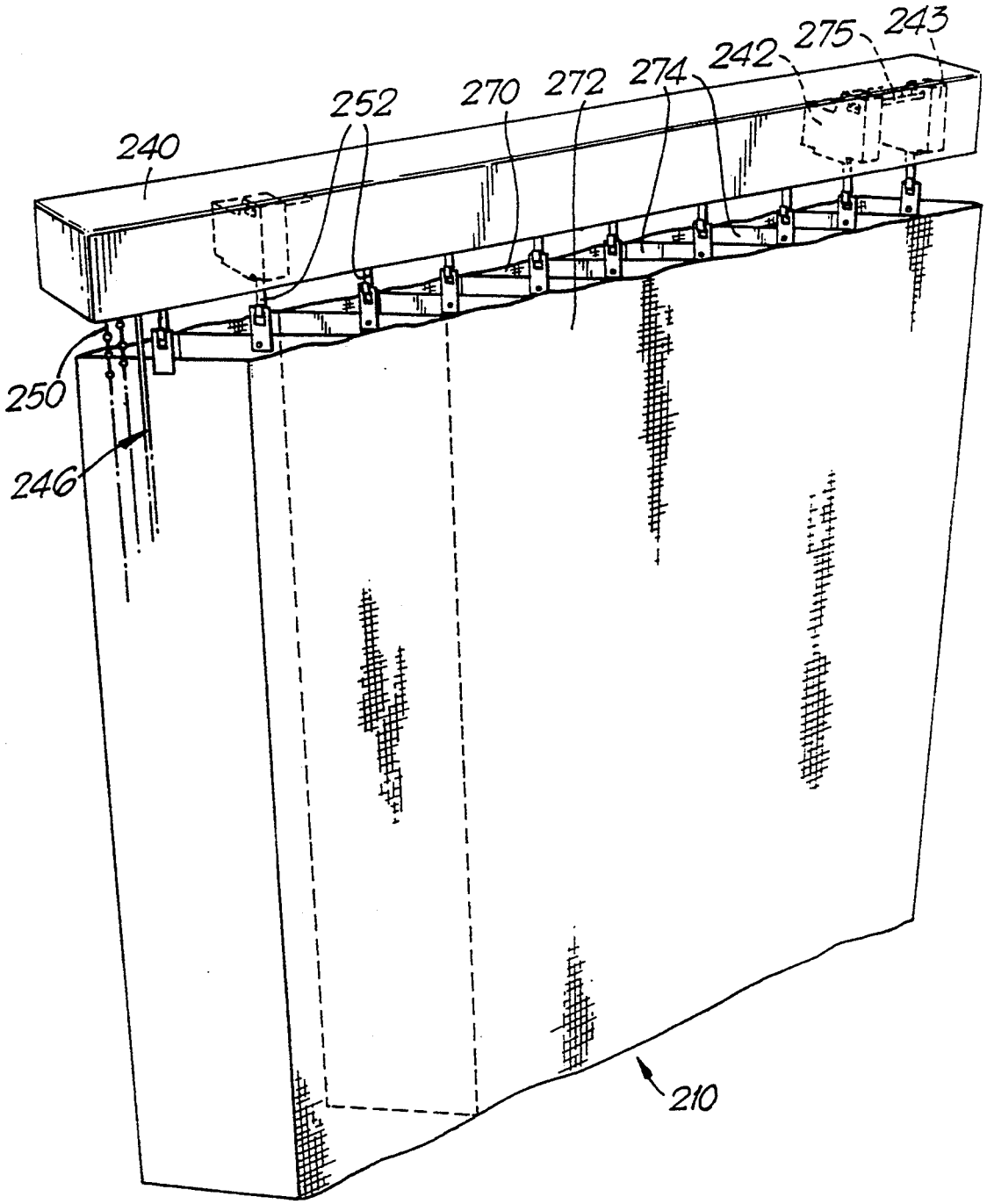

As illustrated in FIG. 20, to be described later, the hangers may be directly coupled to the vanes. In this case, the vanes, which are directly tilted by the hangers, should be sufficiently stiff to operate the window covering from its open towards its closed and collapsed condition.

Figure 18:
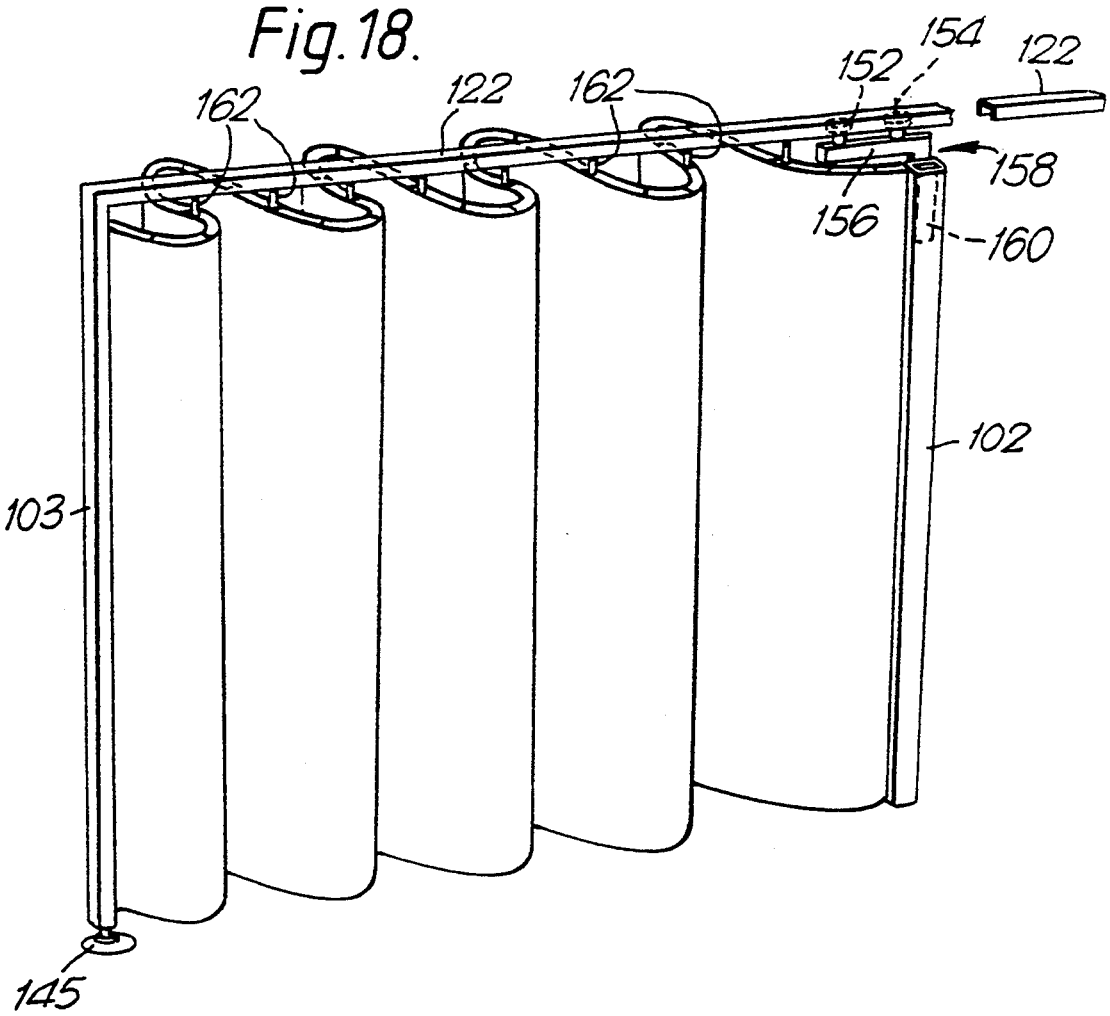
FIG. 18 is a schematic perspective view of a further embodiment of window covering according to the invention.

Referring now to FIGS. 18 and 19, there is again shown a window covering formed in the same manner with two sheer fabrics 10,12 and vanes 14. Secured to the sheer fabric 10 at one end thereof is a first end rail 102 and secured to the other end of the second sheer fabric 12 is a second end rail 103.

Extending above the window covering is a horizontal track 122. The first end rail 102 is mounted on a bracket 158 having a first arm 156 associated with two sliding carriers 152,154 slidable in the track 122 and a second arm 160 engaged in end rail 102. The lower end of the head rail 102 is shown as not riding in a track but it is conceived that it could ride in a lower track similar to upper track 122.

Some, but not all, of the vanes 14 are provided with runners 162. In the construction shown every third vane 14 is provided with a runner 162. This may be in the form of a plastics material plate having an upwardly extending pin with a head on it, which rides in the track 122.

The second end rail 103 is preferably fixed, e.g. as at 145 to the floor.

Figure 19:
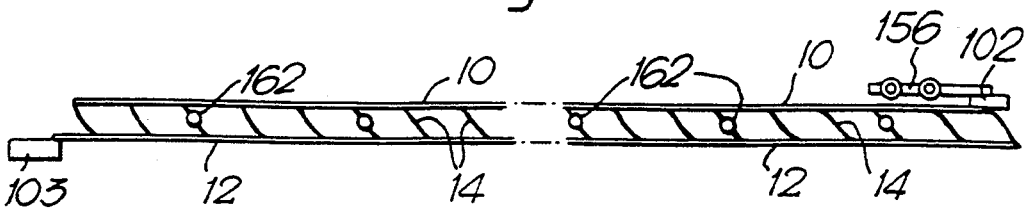
FIG. 19 is a top view of the covering of FIG. 18 in the stretched state.

It will be appreciated that if one grasps the first end rail 102 and moves it to the left, then the covering will concertina up in the manner indicated and will draw back in the manner similar to that of a curtain. If one pulls the end rail 102 to the right then it will stretch out so that the window covering is as shown in FIG. 19. Further movement of the end rail 102 and the bias of the vanes will cause deflection of the vanes 14 to provide more or less passage for light through the covering.

If reference is now made to FIG. 20, there is shown a thead rail 240 in which are mounted a plurality of sliding carriers 242 which are preferably provided with wheels (not shown) for running along guide tracks formed in the headrail. Movement of the carriers 242 can be effected in any suitable manner but as shown a cord system 246 is provided. The assembly of carriers in the headrail may be generally similar to that disclosed in U.S. Pat. No. 3,996,988 in the name Dwight or in U.S. Pat. No. 4,267,875, in the name Koks. As in the Koks patent, a tilt rod may be provided and this may be rotated by a pulley with a bead chain 250. The tilt rod is associated with a worm and wormwheel, as in Koks US U.S. Pat. No. 4,267,875, and the worm wheel in each carrier is connected to a separate hanger 252. Supported by the hangers is a window covering 210 comprising front and rear sheer fabrics 270,272 between which extend vanes 274, which are connected to the fabrics 270,272 in any suitable way e.g. by adhesive. The upper ends of the vanes 274 are mounted on the hangers 252. It will be appreciated that the operation of the vanes can be effected by operation of the bead chain 250 rotating the pulley which in turn rotates the tilt rod. Rotation of this tilt rod will effect rotation of a worm wheel and pinion (not shown) which will in turn cause the hangers 252 to rotate about their respective vertical axes. This rotation will, it will be appreciated, cause tilting of the vanes 274 about their respective vertical axes.

If one operates the pull cord 246 then the end one 43 of the carriers will be pulled to the left or the right. Since these carriers have associated with them spacers 275, movement to the right of the end carrier 243 will cause the adjacent carrier 242 to move to the right with it and then the subsequent carriers will also in turn move to the right to provide the right spacing.

It will be appreciated that when the end carrier 43 is moved to the right, this will have the effect of moving the vane associated therewith. After a certain distance of movement, the sheer fabrics themselves will cause the next vane, and its carrier, to move to the right also and so on.

It is also further contemplated that the structure shown in FIG. 20 could be modified so that there is no facility for moving the carriers 242 along the end rail. Thus, these carriers could be fixed so that the window covering is always in the position as illustrated in FIG. 20 and the only facility for adjustment, therefore, will be adjustment of the angle of the vanes.

Figure 21:
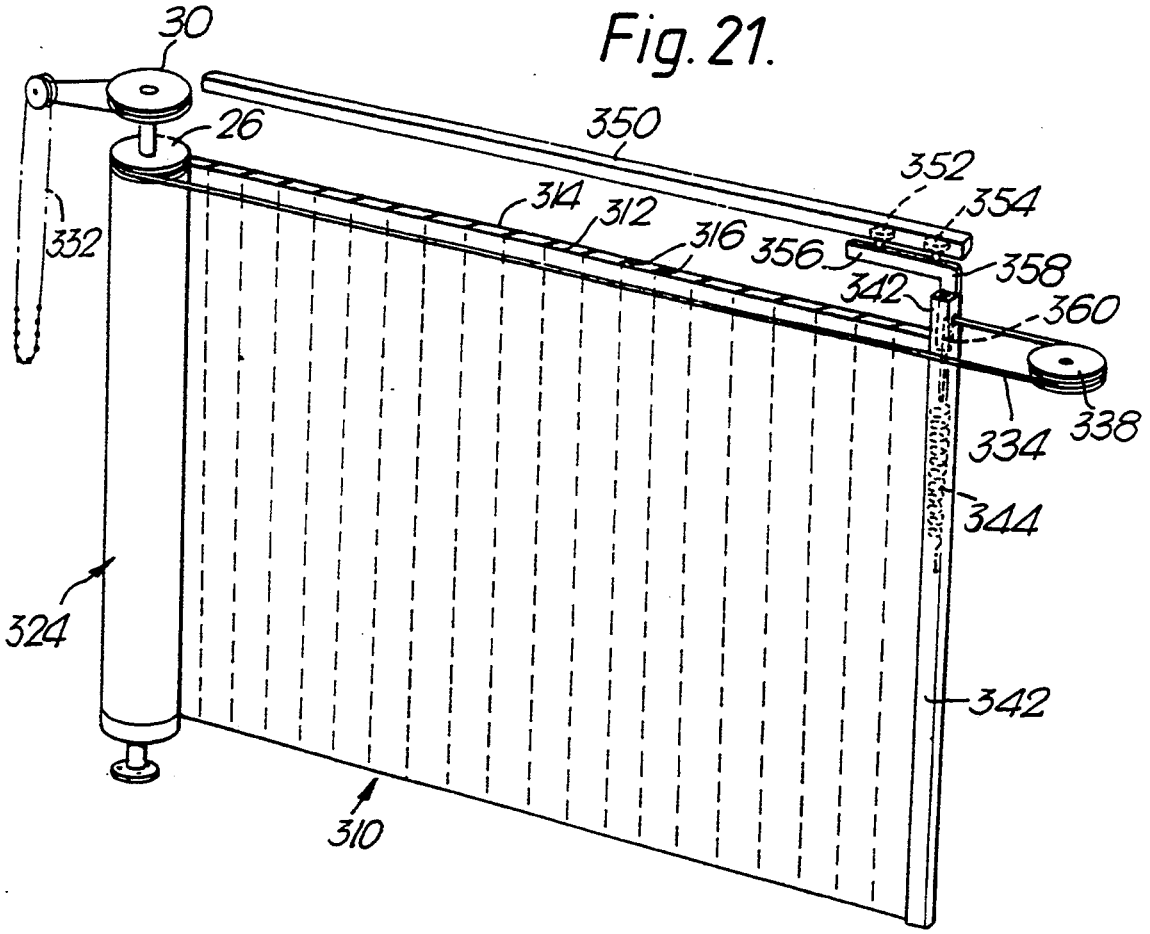
FIG. 21 is a perspective view of a still further embodiment.

In FIG. 21 sheer fabrics 312,314 are connected to circumferentially spaced apart fixing means 320,322 on a wind up roll 324 which is mounted with its longitudinal axis extending generally vertically to one side of the frame of a window. The lower end of the roll can be fixed to the floor or to a location below the window. Vanes 316 extend between fabrics 312 and 314.

Associated with the roll 324, at the upper end thereof, is a cord reel 326 and a control pulley 330 at the end adjacent the reel 326. Rotation of the wind up roll 324 can be effected by operation of a cord, for example a bead cord 332 wrapped around the control pulley 330. Alternatively a motor drive could be provided. This rotation is also imparted to the cord reel 326.

Figure 22:
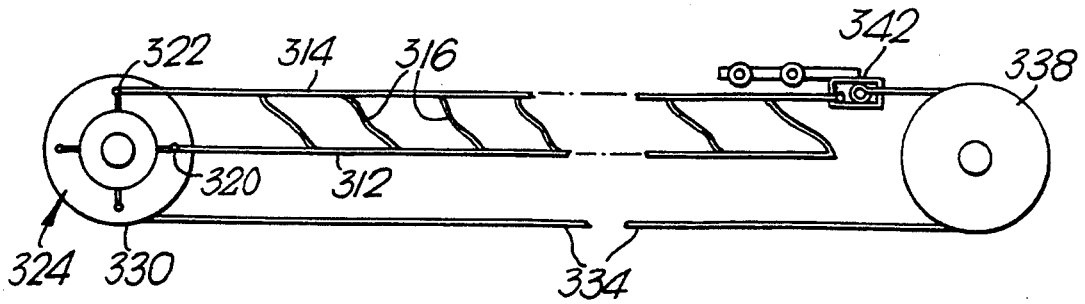
FIG. 22 is an enlarged cross-sectional plan of the assembly of FIG. 21.

Wrapped around the cord reel 326 is a tension cord 334 which also passes around a fixed pulley 338 and is connected to the upper end of an end rail 342 having, in its interior, a tension spring 344 to the upper end of which is attached the end of the tension cord 334. As can be seen more clearly in FIG. 22, the end rail 342 is attached to the second sheer fabric 314 only.

Extending generally horizontally above the window covering 310 is a horizontal track 350 in which are horizontally movable two sliding carriers 352,354 which are attached to one arm 356 of the right angled bracket 358 having a second, lower arm 360 secured to the end rail 342 so that the latter can hang downwardly and be supported by the sliding carriers 352,354 in the track 350. The lower end of the end rail 342 is not secured although it could be guided in a further track at the bottom.

In operation initial movement of the wind up roll 324 will effect the change of the relative angles of the vanes 316 to the sheer fabrics 312,314 and further movement will cause the covering 310 to wind up on the roll 324. As it is rolled up, the sliding carriers 352,354 will slide along the track 350 carrying the end rail 342 with them.

If the roll 324 is operated in the opposite sense, then the end rail 342 will be pulled back by the tension cord 334.

We claim:

1. A light control covering assembly comprising in combination:

a) a covering comprising:
   i) first and second generally parallel spaced apart, longitudinally extending, sheer fabrics, each having a top edge portion and a bottom edge portion;
   ii) a plurality of longitudinally spaced, generally parallel, vertically extending vanes, fixedly secured to said first and second sheer fabrics to extend therebetween; and
   iii) said fabrics and said vanes defining a series of panels composed of a vane and the associated portions of the fabrics, b) a track, and c) carrier means riding in said track between a spread condition and a stacked condition and being connected to said top edge portions of said first and second fabric panels for extending said panels to a vertically planar orientation in which said covering covers an opening when the carrier means are in the spread condition, and in which spread condition the panels can be manipulated to tilt the vanes between a closed position parallel to said fabrics and an open position generally normal to said fabrics to obtain light control, said carrier means comprising plural carriers spaced along said track, each carrier including an actuator member attached to said panels, a rotary drive mechanism for rotating said actuator member to tilt a respective vane between the open and closed positions and rotational energy storing and release means connected between the drive mechanism and the actuator member for storing rotational energy in the actuator member when the actuator is arrested by encountering resistance created by said fabrics in the closed position, and for releasing said energy effective to provide additional rotation of the actuator member when said resistance is relieved by movement of the carriers from the spread condition to the stacked condition so as to stack the covering in substantially parallel folds, wherein each carrier comprises a carriage mounted for movement along said track, a rotary shaft extending from said carriage and connected to said actuator member, a driven gear in said carriage coaxially and rotatably mounted with respect to said shaft.

2. An assembly as claimed in claim 1, wherein each carrier comprises a carriage mounted for movement along said track wherein said drive mechanism includes a shaft depending from said carriage, drive means on said carriage for rotating the shaft and an actuator control element mounted on said shaft for rotation therewith, wherein said actuator member is rotatably mounted on said shaft and wherein said energy storing and release means comprises a tension spring connected between the actuator control element and the actuator member.

3. An assembly as claimed in claim 2, wherein said actuator control element comprises a generally horizontal leg mounted on the shaft and a generally vertical leg depending from the horizontal leg, the vertical leg being adapted to engage a first portion of the actuator member when the vanes are in the open and closed positions and the spring is in its retracted position, and to engage a second portion of the actuator member to limit said continued rotation of the drive mechanism and provide maximum extension of the spring and energy storage in the actuator member.

4. An assembly as claimed in claim 3, wherein said worm drive gear has a central aperture for a drive shaft and the worm drive gears of all of said carriers are connected for rotation in unison by a common drive shaft in the form of a tilt rod.

5. An assembly as claimed in claim 2, wherein said drive means comprises a worm on said shaft and a worm drive gear for rotating said worm.

6. An assembly as claimed in claim 1, wherein each carrier comprises a carriage mounted for movement along said track, wherein said actuator member is carried on a rotary shaft depending from said carriage, wherein said drive mechanism includes a driven gear rotatably mounted around said shaft, a weight mounted on said shaft over said gear for sliding movement on the shaft and rotation therewith, and wherein said energy storing and release means comprises slip coupling means between said weight and said gear for coupling the gear and shaft during movement of the vanes between the open and closed positions, for lifting the eight out of coupling engagement with the gear when the actuator is arrested by encountering said resistance and for allowing the weight to fall back into coupling engagement with the gear accompanied by, rotation of the shaft and actuator member when said resistance is removed.

7. An assembly as claimed in claim 6, wherein said coupling means comprises interfitting inclined camming surfaces on the weight and gear, respectively.

8. An assembly as claimed in claim 6, wherein said gear comprises a worm gear and the drive means further includes a worm in the carriage for rotating the worm gear.

9. An assembly as claimed in claim 8, wherein the worms of all said carriages are connected for rotation in unison by a common tilt rod.

10. An assembly according to claim 1, wherein the energy storing and release means includes a cam member and wherein the cam member and driven gear are provided with mutually interfitting camming surfaces movable out of interfitting engagement for uncoupling the gear and shaft and storing energy in the coupling means.

11. An assembly according to claim 10, wherein the shaft and cam member are fixed axially in the carriage and the driven gear is mounted for axial movement to engage and disengage the camming surfaces.

12. An assembly according to claim 11, including a tension spring for urging the driven gear toward coupling engagement with the cam member.

13. An assembly according to claim 11, wherein the driven gear is mounted above the cam member and urged by gravity toward coupling engagement therewith.

14. An assembly according to claim 13, including a tension spring acting downwardly on the driven gear to provide an additional force urging the driven gear toward coupling engagement with the cam member.

15. An assembly according to claim 1, wherein an end one of said carriage further comprises adjusting means for vertically adjusting the height and a cam member secured to said carriage and wherein the cam member and driven gear are provided with mutually interfitting camming surfaces effective to raise said driven gear and with it the drive shaft and associated actuator member, when the vanes are turned to the open position.

16. An assembly according to claim 1, wherein an end one of said carriers comprises a carriage mounted for movement along said track, and including a fixed support member supporting said covering such that an end one of said vanes is maintained in the open position substantially perpendicular to said first and second generally parallel sheer fabrics.

17. A covering for use in a light control covering assembly for an architectural opening, said covering comprising:

i) first and second generally parallel spaced apart, longitudinally extending, sheer fabrics, each having a top edge portion and a bottom edge portion;

ii) a plurality of longitudinally spaced, generally parallel, vertically extending soft vanes, fixedly secured to said first and second sheer fabrics to extend therebetween; and iii) said fabrics and said vanes defining a series of panels composed of a vane and the associated portions of the fabrics, said covering being intended for covering an opening by extending said panels to a vertically planar orientation wherein the panels can be manipulated to tilt the vanes between a closed position parallel to said fabrics and an open position generally normal to said fabrics to obtain light control and wherein each sheer fabric has dimensional stability in substantially mutually perpendicular directions inclined to the vertical.

18. A covering as claimed in claim 17, wherein one of the sheer fabrics has diamond-shaped interstices and the other sheer fabric has rectangular interstices with inclined loop threads which are undetectable except by microscope.

19. A covering as claimed in claim 17, wherein one of said fabrics is a tulle fabric having diamond-shaped interstices having a major axis and a minor axis, said major axis extending substantially vertically and wherein the other of said fabrics comprises a knitted fabric including warp yarns extending substantially vertically and a plurality of fill yarns extending between the warp yarns at acute angles to the horizontal to provide said dimensioned stability.

20. A light control shade assembly comprising in combination;

a) a shade member having an upper edge portion and comprising:

i) first and second generally parallel spaced apart, vertically extending translucent sheets, at least one of said sheets having dimensional stability in substantially mutually perpendicular directions inclined to the vertical;

ii) a plurality of longitudinal, parallel spaced vertically extending soft vanes, fixedly secured with their opposite longitudinal edges to said first and second sheets to extend therebetween;

b) carrier means connected to said shade member to suspend said shade member in an extended vertically planar condition in which said shade member is effective in shading a predetermined area and in which condition the vanes can be manipulated to alter their orientation between a closed position parallel to said first and second sheets and an open position generally perpendicular to said first and second sheets to obtain light control in the shaded area.

21. A light control shade according to claim 20, wherein said carrier means comprise a headrail and at least one hanger member connected to the upper edge portion of said shade member.

22. A light control shade according to claim 21, wherein manipulation of the vanes is effected by tilting of said at least one hanger member.

23. A light control shade according to claim 21, wherein said carrier means comprise additional hanger members connected at spaced intervals to the upper edge portion of said shade member.

24. A light control shade according to claim 20, wherein said carrier means comprise track means and at least one carriage member at one vertical side edge of said shade member, traversable along said track means and a fixed end member at an opposite vertical side edge of said shade member.

25. A light control shade according to claim 20, wherein said at least one sheer fabric sheet has its threads arranged inclined to the vertical.

26. A light control shade assembly according to claim 25, wherein both said first and second sheets are formed by sheer fabric and wherein the other sheer fabric has its threads normal and parallel to the vertical with additional diagonally extending loop threads in an arrangement and proportion avoiding a moire effect in the shade member.

27. A light control shade assembly according to claim 20, wherein each of said first and second sheets has a reinforcing band extending along a top edge thereof and wherein the vanes are manipulated by actuator members connected to a respective one of said reinforcing bands.

28. A light control shade assembly according to claim 20 or 27, wherein said carrier means comprises a plurality of carriers spaced along a generally horizontal track means, each carrier including an actuator member for tilting at least one of said vanes between the open and closed positions.

29. A light control shade assembly according to claim 20, further comprising:

a horizontal guide track and wherein said carrier means are slidably mounted for movement along said track between a spread and a stacked condition and are connected to the upper edge portion of said shade member for extending said shade member to said vertically planar condition and wherein when the carrier means are in the spread condition the vanes can be manipulated to alter the orientation of the vanes between said closed position parallel to said first and second sheets and to said open position generally perpendicular to said first and second sheets to obtain light control as well as for imposing a force on said shade member in the closed position of the vanes, such that when said carrier means are moved towards the stacked condition, the imposed force is relieved and the shade member urged into folding.

30. A light control shade assembly according to claim 29, wherein said carrier means comprises a plurality of carriages spreadable along said track, each carriage including an actuator member attached to the upper edge portion of said shade member, a drive mechanism for rotating said actuator member to tilt at least one of said vanes between the open and closed positions and energy storing and release means connected between the drive mechanism and the actuator member for storing energy in the actuator member in a fully extended and closed position of said shade member and for releasing said energy when said carriages are moved to the stacked condition effective to provide continued further rotation of the actuator member.

31. A light control shade assembly according to claim 30, wherein said drive mechanism includes a rotary shaft depending from the carriage, drive means on the carriage for rotating the shaft and an actuator control element mounted on the shaft for rotation therewith, wherein the actuator member is mounted for rotation on the shaft and wherein said energy storing and release means comprises a resilient tensioning means connected between the actuator control element and the actuator member.

32. A light control shade assembly according to claim 30, wherein said energy storing and release means comprises a weight means movable in opposition to gravity.

33. A light control shade assembly according to claim 32, wherein each actuator member includes a pair of depending pivoted hangers each attached to a respective one of said first and second sheets and defining the attachment means.

34. A light control shade assembly according to claim 33, wherein each sheet has a reinforcing band extending along a top edge thereof and wherein each hanger is attached to a respective fabric by a pin extending through the sheet, the reinforcing band the hanger.

35. A light control shade assembly according to claim 29 or 32, wherein said actuator member is carried on a rotary shaft depending from said carriage wherein said drive mechanism includes a driven gear, driving said shaft through an energy storing and release means in the form of an overriding clutch having interfitting inclined camming surfaces adapted to convert rotary movement to axial energy storing movement and vice versa as a function of resistance encountered during rotation of the gear.

36. A light control shade assembly according to claim 20, wherein the actuator members of the respective carriages are attached to the shade member for every other vane.

37. A light control shade assembly according to claim 36, wherein said actuator member comprising an arm having opposite attachment hangers, one hanger being attached to the first sheet at a location where a vane is attached to the inside face of said first sheet.

38. A light control covering assembly comprising in combination:

a) a covering comprising:

i) first and second generally parallel spaced apart, longitudinally extending, sheer fabrics, each having a top edge portion and a bottom edge portion, at least one of said sheer fabrics having dimensional stability in substantially mutually perpendicular directions inclined to the vertical;

ii) a plurality of longitudinally spaced, generally parallel, vertically extending, soft vanes, fixedly secured to said first and second sheer fabrics to extend therebetween; and iii) said fabrics and said vanes defining a series of panels composed of a vane and the associated portions of the fabrics;

b) a track; and c) carrier means riding in said track between a spread condition and a stacked condition and being connected to said top portions of said panels for extending said panels to a vertically planar orientation in which said covering covers an opening when the carrier means are in the spread condition, and in which spread condition the panels can be manipulated to tilt the vanes between a closed position substantially parallel to said fabrics and an open position generally normal to said fabrics to obtain light control, whereby said vanes do not generally twist when tilted.

39. An assembly as claimed in claim 38, wherein one of the sheer fabrics has diamond-shaped interstices and the other sheer fabric has rectangular interstices with inclined loop threads.

* * * * *

UNITED STATES PATENT AND TRADEMARK OFFICE

CERTIFICATE OF CORRECTION

PATENT NO. : 5,392,832

DATED : February 28, 1995

INVENTOR(S) : Wendell B. Colson, et al.

It is certified that error appears in the above-indentified patent and that said Letters Patent is hereby corrected as shown below:

| | |
|---|---|
| Cover Page, "U.S. Patent Documents" listing, line 1 | "--3,421,2--" should read -- 3,421,276 -- |
| Cover Page, "Foreign Patent Documents" listing, line 6 | "--136467--" should read -- 1364674 -- |
| Column 2, line 29 | "--covering-over-closed--" should read -- covering over-closed -- |
| Column 7, line 65 | "--arrows--" should read -- arrows B. -- |
| Column 11, line 34 | "--30--" should read -- 30 ′ -- |
| Column 11, line 35 | "--40--" should read -- 40 ′ -- |
| Column 11, line 35 | "--28--" should read -- 28′ -- |
| Column 20, lines 49-50 | "--claim 32--" should read -- claim 30 -- |

Signed and Sealed this

Eleventh Day of June, 1996

*Attest:*

*Attesting Officer*

Bruce Lehman

BRUCE LEHMAN

*Commissioner of Patents and Trademarks*